United States Patent [19]

Wright et al.

[11] Patent Number: 4,919,269

[45] Date of Patent: Apr. 24, 1990

[54] MULTIPLE COMPARTMENT CONTAINER

[75] Inventors: James W. Wright, Woodstock; John M. Holley, Jr., Norcross, both of Ga.

[73] Assignee: The Mead Corporation, Dayton, Ohio

[21] Appl. No.: 273,389

[22] Filed: Nov. 18, 1988

[51] Int. Cl.[5] ..... B65D 5/48; B65D 5/54

[52] U.S. Cl. ..... 206/602; 229/120.03; 229/120.08

[58] Field of Search ..... 206/602, 611, 620; 229/120.03, 120.08, 120.11, 120.17

[56] References Cited

U.S. PATENT DOCUMENTS

| | | | |
|---|---|---|---|
| 3,048,321 | 8/1962 | Sanford | 206/602 |
| 3,135,457 | 6/1964 | Risucci | 206/602 |
| 4,228,945 | 10/1980 | Wysocki | 206/602 |
| 4,263,769 | 4/1981 | Hanazawa et al. | 206/602 |
| 4,485,926 | 12/1984 | Lenzmeier | 206/602 |
| 4,793,494 | 12/1988 | Gordon, Jr. | 206/602 |

*Primary Examiner*—Gary Elkins

*Attorney, Agent, or Firm*—Thomas A. Boshinski

[57] ABSTRACT

A multiple compartment, separable container includes a common top wall, with outer side walls connected to each side edge of the top wall. A bottom wall is connected to each outer side wall, with an inner side and a lap panel connected in turn. Each lap panel is secured in underlying fashion to the top wall, with the inner side walls in face-to-face relationship. A beveled end panel is connected to each end of the inner side walls. A minor end panel is connected to each of the beveled end panels. Lower end panels are connected to the bottom walls, with an upper end panel connected to each end of the top wall. A web structure interconnects each minor end panel with the adjacent end panels and lap panels. A tear strip defined by a pair of parallel, perforated tear lines extends across the top wall and across each upper end panel. Each tear line overlies one lap panel between the free edge of the lap panel and the connections between the lap panel and web structures. Upon separating the individual compartment, the torn edge will be set back from the bevelled end panels.

6 Claims, 3 Drawing Sheets

MULTIPLE COMPARTMENT CONTAINER

BACKGROUND OF THE INVENTION

The present invention relates generally to a tubular carton or container and, more particularly, to such a container which is formed to include multiple article receiving compartments, and which may be separated to form a plurality of single compartment cartons.

It has, of course, long been known to package a plurality of articles within a carton or container to facilitate the purchase of a quantity of such articles by the consumer. For example, beverages packaged in individual cans or bottles may be placed into an end loading carton which holds a predetermined number of the cans or bottles. It is also known, but less common, to form the carton such that it defines a pair of article receiving compartments so that the carton may be conveniently split into two sections. For example, a carton can be designed having two compartments each holding twelve beverage cans. The entire carton, i.e., 24 cans, may be easily transported, or the carton may be split to produce two individual cartons of twelve cans each. The separation of the individual compartments may be done at the point of sale so that smaller quantities of the product may be sold, or may be performed later by the purchaser at his convenience.

Such a carton is shown in U.S. Pat. No. 3,677,458. There, the carton is formed having a common top wall and, for each compartment, individual side and bottom walls. The compartments are arranged with inner side walls placed adjacent each other. A tear strip is formed across the top wall along the line where the facing inner side walls meet the top wall. Removal of this tear strip enables the two compartments to be separated into individual containers.

One disadvantage with the multiple compartment container described above is that the separate bottom and inner side walls lessen the rigidity of the undivided container. Thus, the carton will feel less stable, may prematurely separate, may bend along the line of the tear strip or may skew causing difficulties in stacking a number of the containers. Further, the bending or skewing of the container may even lead to unwanted rupture of the compartments.

A further disadvantage of the multiple compartment container may result when using improvements in carton design made subsequent to the above-mentioned disclosure. It is now known to provide beveled ends for such cartons as a means of increasing the strength and rigidity of the carton. An example of this construction may be seen in U.S. Pat. No. 4,216,861. The ends of the carton side walls are connected along fold lines to beveled end panels, which are in turn connected along fold lines to the end closing panels of the carton.

In relating this structure to the multiple compartment container, it should be noted that the beveled ends causes the facing inner side walls of the individual compartments to diverge near the ends thereof. This means that upon separating the carton into the components, portions of the top wall will project outwardly from the beveled side edges. This is not only unsightly, but presents an exposed edge which could, in the handling of the individual compartments, lead to tearing of the carton. One possible solution would be to terminate the tear strip on the common top wall at the points where the beveled end walls meet the inner side walls. However, this would reduce the connecting portion of the top wall and further decrease the stability of the overall carton.

What is needed, therefore, is a multi-compartment container which provides increased rigidity and stability prior to separation of the compartments into separate containers, and which provides a neat appearance and secure enclosure for the individual, separated compartments.

SUMMARY OF THE INVENTION

The present invention meets the foregoing needs in providing a multiple compartment, separable container. The container includes a common top wall, with outer side walls connected along a fold line to each opposing side edge of the top wall. A bottom wall is connected along a fold line to each outer side wall at an edge thereof opposite the top wall. An inner side wall is connected along a fold line to each bottom wall, connected along an edge of the bottom wall opposite the outer side wall. Finally, a lap panel is connected along a fold line to each inner side wall at an edge thereof opposite the bottom wall.

Each of the lap panels is secured in underlying fashion to the top wall, whereby the inner side walls are disposed in face-to-face relationship.

In one form of the invention, minor end panels are connected along fold lines to each of the inner and outer side walls. A major lower end panel is connected along the fold line to each end of each of the bottom walls, with a major upper end panel connected along a fold line to each end of the top wall. A web structure interconnects along fold lines each minor end panel with adjacent ones of the lower major end panels and the lap panels.

A tear strip is defined in the top panel by a pair of parallel, perforated tear lines. These lines extend across the top wall parallel to the planes of the side walls. Each of the tear lines overlies one of the lap panels between the free edge of the lap panel and the connections between the lap panel and the web structures. By this construction, once the individual compartments have been separated, the torn edge will be set back from the upper edge of the individual compartment, thereby providing a neat appearance and eliminating protruding panel corners which could lead to tearing or other damage to the separated compartments.

The minor end panels may include beveled end panels, each of which are connected along a fold line to an end of one of the inner and outer side walls. In such a case, the tear lines are prefereably positioned to overlie the lap panels so that upon removal of the tear strip, the upper ends of the beveled end panels which connect to the inner side walls are exposed. This also prevents protruding panel corners.

According to another form of the invention, the container again includes a common top wall, with outer side walls connected to each opposing side edge of the top wall. A bottom wall is connected to each outer side wall, and an inner side wall is connected along a fold line to each bottom wall. A lap panel is connected to each inner side wall at an edge thereof opposite the bottom wall. Each of the lap panels is secured in underlying fashion to the top wall, with the inner side walls disposed in face-to-face relationship.

A major lower end panel is connected along the fold line to each end of each of the bottom walls, with a major upper end panel connected along a fold line to each end of the top wall. The tear strip is defined in the top panel by a pair of parallel, perforated tear lines. These lines extend across the top wall parallel to the planes of the side walls. The tear lines extend not only across the entire width of the top panel, but also entirely across each of the major upper end panels. This construction provides increased strength and rigidity to the carton prior to separation, since the major upper end panels effectively become common walls.

Accordingly, it is an object of the present invention to provide an improved multiple-compartment, separable container: to provide such a container which may be easily and conveniently separated by a tear strip; to provide such a container which has increased strength and rigidity prior to separation of the individual compartments: and to provide such a container wherein the separated compartments are of neat appearance and secure construction.

Other objects and advantages of the present invention will be readily apparent from the following description, the accompanying drawings and the appended claims.

DETAILED DESCRIPTION OF THE PREFERRED EMBODIMENTS

Figure 1:
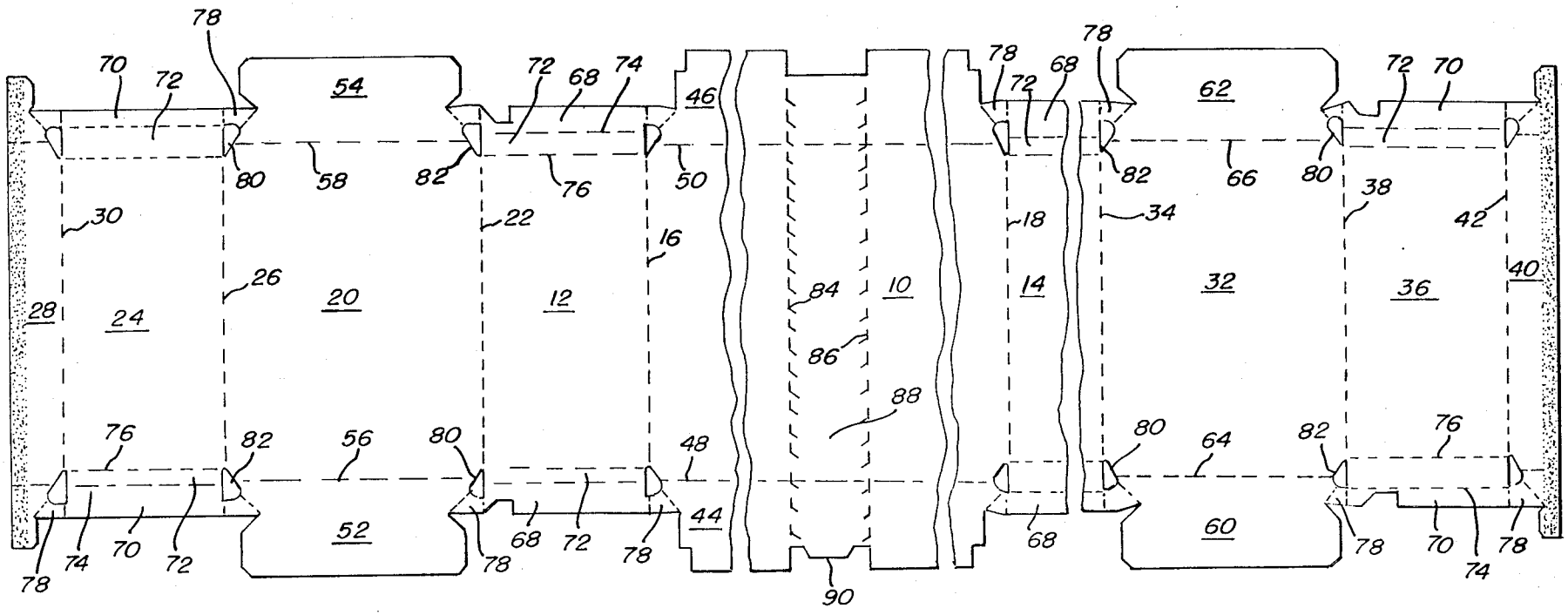
FIG. 1 is a plan view of the outer side of a blank from which the multiple-compartment container is formed according to the invention.

Referring now to the drawings, FIG. 1 shows the outer side of a blank from which a multiple-compartment container in accordance with one preferred embodiment of the present invention is formed. Numeral 10 designates the common top wall of the carton, to the side edges of which side walls 12 and 14 are foldably joined along fold lines 16 and 18 respectively. (Top wall 10 and side wall 14 are shown with broken portions for purposes of illustration.) A bottom wall 20 for one compartment of the carton is foldably joined to the edge of side wall 12 along fold line 22. An inner side wall 24 is connected to bottom wall 20 along a fold line 26, and a lap panel 28 is joined to inner side wall 24 along fold line 30. In a similar manner, bottom wall 32 for a second compartment of the container is connected to side wall 14 along fold line 34. Inner side wall 36 joins bottom wall 32 along fold line 38, while lap panel 40 is connected to inner side wall 36 along fold line 42.

End closure structure is, in part, provided for the container in the form of upper major end panels 44 and 46 which are foldably joined to the end edges of top wall 10 along fold lines 48 and 50 respectively. Lower major end panels 52 and 54 are foldably joined to the end edges of bottom wall 20 along fold lines 56 and 58 respectively. In similar fashion, lower end panels 60 and 62 are foldably joined to the end edges of bottom wall 32 along fold lines 64 and 66 respectively.

Additional end closure structure is provided in the form of minor end panels 68 which are positioned near the side edges of outer side walls 12 and 14. Similar minor end panels are positioned adjacent the side edges of inner side walls 24 and 36. Located between each minor end panel 68 and 70 and the corresponding outer side walls 12 and 14 and inner side walls 24 and 36 are beveled corner panels 72. Each beveled corner panel 72 is connected to the adjacent minor end panel by a fold line 74, and is connected on an opposite edge by a fold line 76 to the adjacent one of inner and outer side walls 12, 14, 24 or 36.

As is apparent from FIG. 1, fold lines 74 are offset outwardly of fold lines 48, 50, 56, 58, 64 and 66, while fold lines 76 are offset inwardly of fold lines 48, 50, 56, 58, 64 and 66. These offset relationships account for the angular dispositions of the corner beveled panels 68 and 70.

Means to interconnect the various end flaps is provided in the form of web structures 78, each of which is virtually identical. Each web structure 78 connects adjacent major and minor end panels. In each case, the web structure 78 is separated from the corresponding top wall 10, bottom wall 20 or 32, or lap panel 28 or 40 by an opening 80 which includes a beveled edge 82 that defines the corner of each top wall, bottom wall or lap panel so that these portions match the beveled corner configuration of the end wall.

To enable the individual compartments of the container to be separated, a pair of parallel perforated tear lines 84 and 86 are formed to extend across the width of top wall 10, and onto and across the upper end panels 44 and 46. Tear lines 84 and 86 define between them a tear strip 88 which, upon removal, results in separation of the individual compartments. Formed at one end of tear strip 88 is a tab 90 that facilitates gripping of tear strip 88 for removal. The width of tear strip 88, i.e., the distance between perforated lines 84 and 86, will be considered in detail below.

To form the carton from the blank shown in FIG. 1, folds are made along lines 16, 22, 26 and 30 to place top wall 10, bottom wall 20, side walls 12 and 24 and lap panel 28 into perpendicular relationship with adjacent walls. Glue, which is applied to lap panel 28 as indicated by stippling, is used to secure lap panel 28 to the underside of top wall 10. Similar folds are made along lines 18, 34, 38 and 42, with glue being used to secure lap panel 40 to the underside of top wall 10. Upon completion of these steps, the carton appears as shown in FIG. 2, with the inner side walls 20 and 36 being positioned adjacent each other in face-to-face relation.

Figure 3:
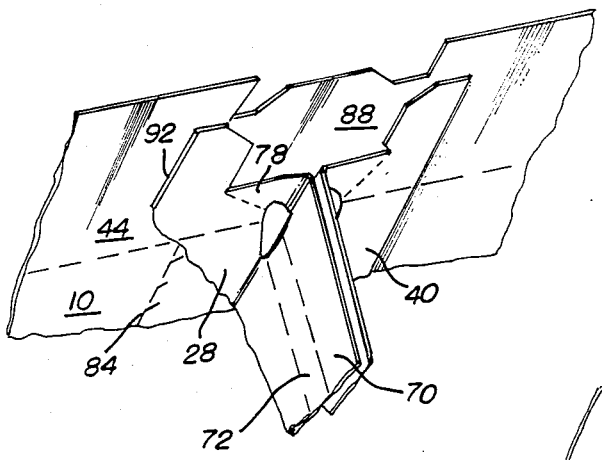
FIG. 3 is a partial perspective view looking up under the upper end panel with the beveled end panels in an unfolded position.

Referring now to FIG. 3, a view looking beneath the upper end panel 44 at the region where inner side walls 24 and 36, top wall 10 and upper end panel 44 all meet is shown. From FIG. 3, the positioning of lap panels 28 and 40 on the under side of top wall 10 and end panel 44 can be seen, as well as the relationship between these portions and perforated tear lines 84 and 86. Particularly, it should be noted that lap panel 28 is located such that it completely covers tear line 84. At the same time, tear line 84 must be positioned between the end edge 92 of lap panel 28 and the web structure 78 which connects lap panel 28 with minor end flap 70. Moreover, any glue which had previously been applied to lap panel 28 to secure it to top wall 10 and end panel 44 must be located on lap panel 28 such that the glued portion is entirely between tear line 84 and edge 92 of lap panel 28. A similar configuration is used for lap panel 40 and tear line 86.

Figure 2:
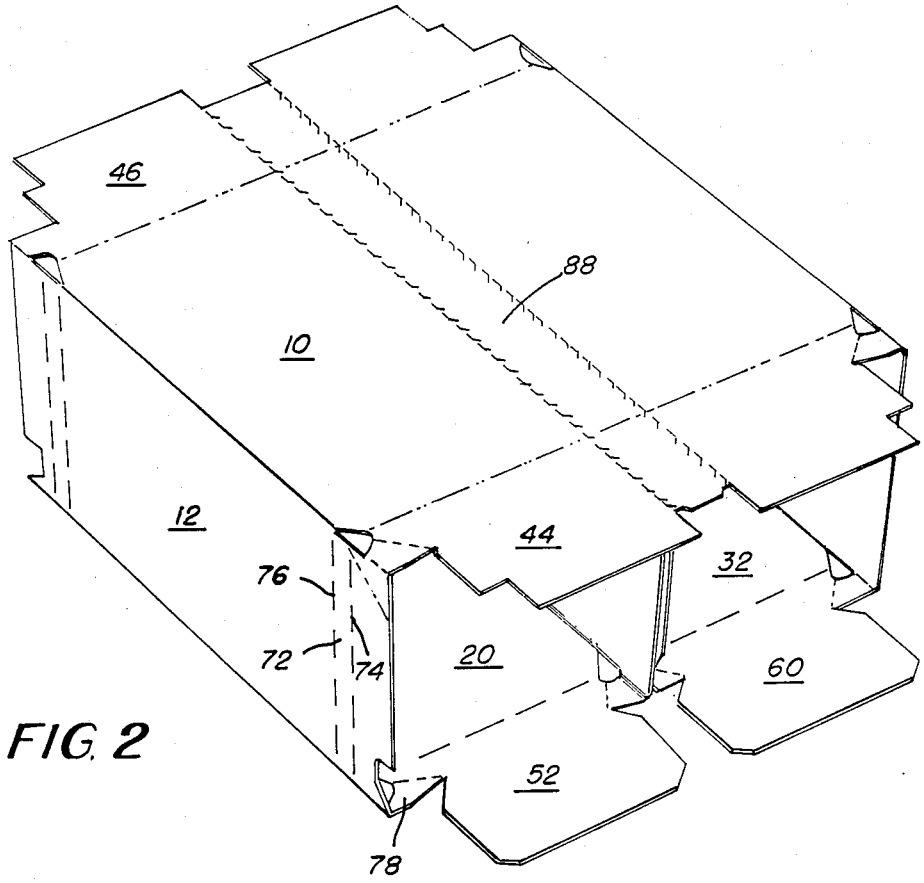
FIG. 2 is a perspective view of the container with both ends open as it is when the container is being loaded.
Figure 4:
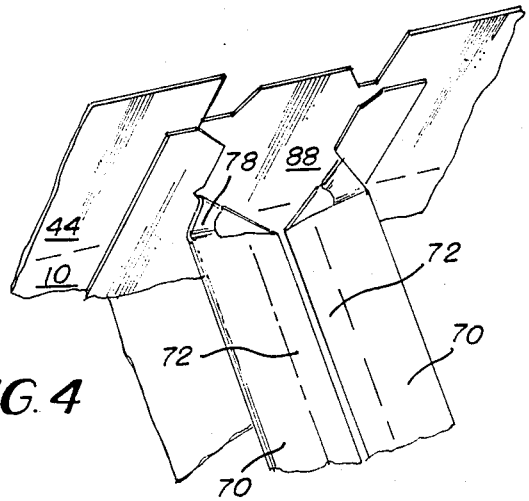
FIG. 4 is a view similar to FIG. 3 but with the beveled end panels moved to their folded position.

The container is shown in FIG. 2 in the proper condition for loading with cans, bottles or the like. After these articles are loaded into the carton, the minor end flaps 68 and 70 and beveled corner panels 72 are folded inwardly along fold lines 74 and 76. As this occurs, the offset of fold lines 74 and 76 with respect to the fold lines joining the major end flaps to the top and bottom walls causes the beveled corner panels 72 to assume their angled relation and causes the web structures 78 to fold into a position whereby the minor end flaps 68 and 70 and beveled corner panels 72 are held firmly in position. The positioning of such panels may be seen by reference to FIG. 4, and their operation is explained in greater detail in U.S. Pat. No. 4,216,861.

To complete the carton, the major upper end panels 44 and 46 are folded downwardly along fold lines 48 and 50, respectively. Lower major end panels 52, 54, 60 and 62 are folded upwardly along fold lines 56, 58, 64 and 66 respectively. Glue is applied to either the upper or lower end panels to secure them, producing a closed carton as shown in FIG. 5.

Figure 6:
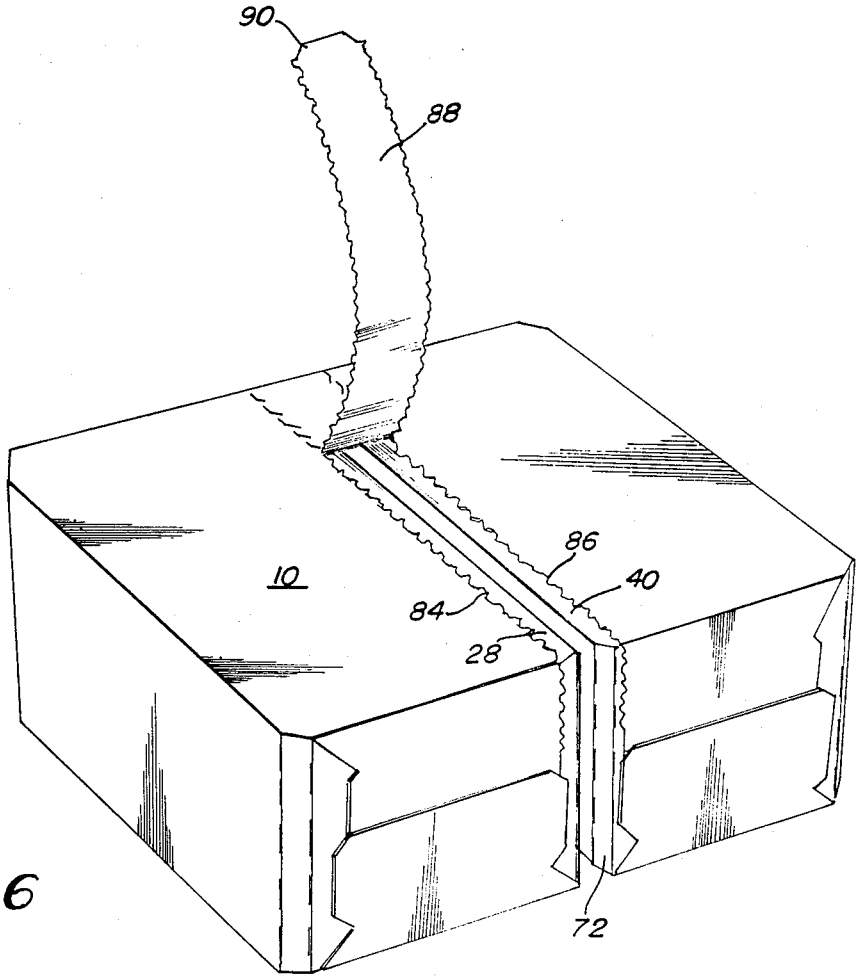
FIG. 6 is a view similar to FIG. 5 but illustrating removal of the tear strip for separating the individual compartments.

Separation of the multi-compartment container into individual small containers can be seen by reference to FIG. 6. Tab 90 is gripped and tear strip 88 is pulled upwardly, thereby separating the tear strip 88 from top wall 10 along perforated lines 84 and 86. If beveled corner panels are provided as shown, lines 84 and 86 are positioned remote from the beveled corner panels 72 so that as tear strip 88 is removed, the upper ends of beveled corner panels 72 are entirely exposed. This prevents any overhang of top wall 10 over the beveled corner of the separated individual compartment. This is important from an appearance standpoint and also avoids a protruding edge which could lead to unwanted tearing or other damage to the separated container.

Of course, it will be recognized that the separation of the perforated lines 84 and 86 also can be used for a container which does not rely on the beveled corner panels 72 for additional strength. In such a case, the tear lines are positioned such that upon removal of the tear strip 88, the torn edge will be set back from the carton edge formed by the fold line connecting the lap panel and inner side wall. In this case as well, appearance of the separated compartments is enhanced, and protruding or loose edges are made less likely.

Figure 5:
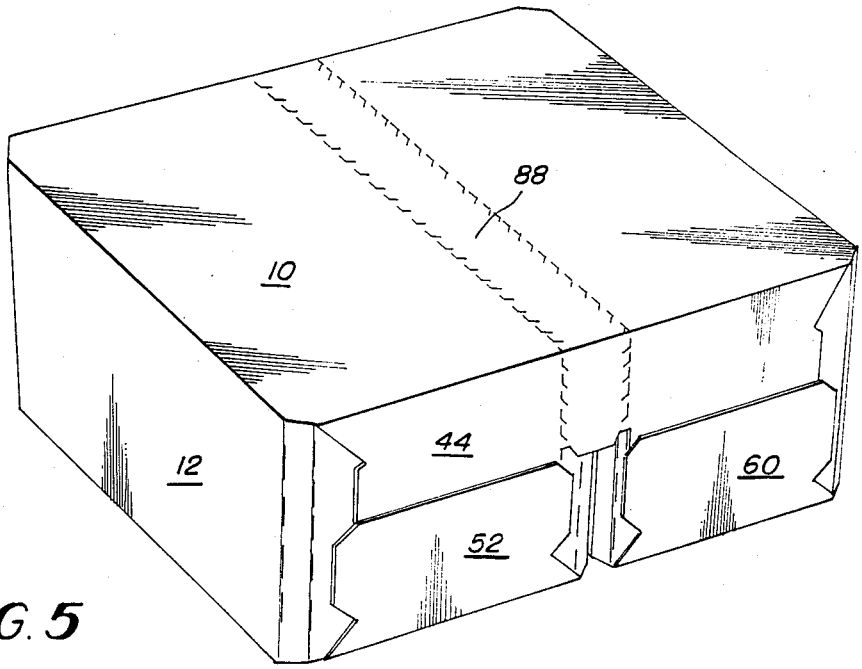
FIG. 5 is a perspective view of the container showing the container in closed condition.

It should also be noted from FIGS. 5 and 6 that tear strip 88 extends onto upper end panel 44 and upper end panel 46, the latter not being visible in FIGS. 5 and 6. This further feature of the invention is also important, since integral walls are provided on the unseparated container not only along the top of the container but partially along two ends of the container as well. This provides added strength and rigidity to the container prior to separation of the individual compartments.

While the container described herein constitutes a preferred embodiment of this invention, it is to be understood that the invention is not limited to this precise embodiment and that changes may be made therein without departing from the scope of the invention, which is defined in the appended claims.

What is claimed is:

1. A multiple-compartment, separable container comprising:

a common top wall;

an outer side wall connected along a fold line to each opposing side edge of said top wall;

a bottom wall connected along a fold line to each outer side wall at an edge thereof opposite said top wall;

an inner side wall connected along a fold line to each bottom wall at an edge thereof opposite said outer side wall;

a lap panel having a free edge and connected opposite said free edge along a fold line to each inner side wall at an edge thereof opposite said bottom wall;

each of said lap panels being secured in underlying fashion to said top wall so that said inner side walls are disposed in face-to-face relationship;

minor end panels connected along fold lines to each end of each of said inner side walls and said outer side walls;

a major lower end panel connected along a fold line to each end of each of said bottom walls;

a major upper end panel connected along a fold line to each of said top wall;

a tear strip defined in said top panel by a pair of parallel perforated tear lines extending across said top panel parallel to the planes of said side panels;

each of said tear lines overlying one of said secured lap panels between the free edge of said lap panel and the connection between said lap panel and the adjoining one of said inner side walls; and a web structure interconnecting along fold lines each minor end panel with adjacent ones of said lower major end panels and said lap panels, each of said tear lines overlying one of said secured lap panels between said free edge of said lap panel and the connections between said lap panel and said web structures.

2. The container of claim 1, wherein said tear lines further extend entirely across each of said major upper end panels.

3. The container of claim 1, wherein said lap panels are secured to said top wall by gluing, wherein glue is applied only between said free edge of said lap panel and a corresponding one of said tear lines.

4. A multiple-compartment, separable container comprising:

a common top wall;

an outer side wall connected along a fold line to each opposing side edge of said top wall;

a bottom wall connected along a fold line to each outer side wall at an edge thereof opposite said top wall;

an inner side wall connected along a fold line to each bottom wall at an edge thereof opposite said outer side wall;

a lap panel having a free edge and connected opposite said free edge along a fold line to each inner side wall at an edge thereof opposite said bottom wall;

each of said lap panels being secured in underlying fashion to said top wall so that said inner side walls are disposed in face-to-face relationship;

a lower end panel connected along a fold line to each end of each of said bottom walls;

an upper end panel connected along a fold line to each end of said top wall; and a tear strip defined in said top panel by a pair of parallel perforated tear lines extending across said top panel parallel to the planes of said side panels;

each of said tear lines overlying one of said secured lap panels between the free edge of said lap panel and the fold line connecting said lap panel and one of said inner side walls;

said tear lines further extending entirely across each of said major upper end panels.

5. The container of claim 4, wherein said lap panels are secured to said top wall by gluing, wherein glue is applied only between said free edge of said lap panel and a corresponding one of said tear lines.

6. A multiple-compartment, separable container comprising:

a common top wall;

an outer side wall connected along a fold line to each opposing side edge of said top wall;

a bottom wall connected along a fold line to each outer side wall at an edge thereof opposite said top wall;

an inner side wall connected along a fold line to each bottom wall at an edge thereof opposite said outer side wall;

a lap panel having a free edge and connected opposite said free edge along a fold line to each inner side wall at an edge thereof opposite said bottom wall;

each of said lap panels being secured in underlying fashion to said top wall so that said inner side walls are disposed in face-to-face relationship;

minor end panels connected along fold lines to each end of each of said inner side walls and said outer side walls;

a major lower end panel connected along a fold line to each end of each of said bottom walls;

a major upper end panel connected along a fold line to each end of said top wall;

a tear strip defined in said top panel by a pair of parallel perforated tear lines extending across said top panel parallel to the planes of said side panels;

each of said tear lines overlying one of said secured lap panels between the free edge of said lap panel and the connection between said lap panel and the adjoining one of said inner side walls;

a web structure interconnecting along fold lines each minor end panel with adjacent ones of said lower major end panels and said lap panels, each of said tear lines overlying one of said secured lap panels between said free edge of said lap panel and the connections between said lap panel and said web structures;

said minor end panels including beveled end panels each connected along fold lines to each end of each of said outer and inner side walls; and said tear lines overlying said lap panels such that upon removal of said tear strip, upper ends of said beveled end panels connected to said inner side walls are exposed.

* * * * *